US011391008B2

(12) United States Patent
Brouwer

(10) Patent No.: US 11,391,008 B2
(45) Date of Patent: Jul. 19, 2022

(54) TEMPLATE AND A METHOD OF USING THE TEMPLATE

(71) Applicant: IHC HOLLAND IE B.V., Sliedrecht (NL)

(72) Inventor: Willibrordus Adelbertus Maria Brouwer, Sliedrecht (NL)

(73) Assignee: IHC HOLLAND IE B.V., Sliedrecht (NL)

( * ) Notice: Subject to any disclaimer, the term of this patent is extended or adjusted under 35 U.S.C. 154(b) by 0 days.

(21) Appl. No.: 16/621,382

(22) PCT Filed: Jun. 7, 2018

(86) PCT No.: PCT/NL2018/050371
§ 371 (c)(1),
(2) Date: Dec. 11, 2019

(87) PCT Pub. No.: WO2018/231049
PCT Pub. Date: Dec. 20, 2018

(65) Prior Publication Data

US 2021/0140135 A1 May 13, 2021

(30) Foreign Application Priority Data

Jun. 14, 2017 (NL) ..... 2019068

(51) Int. Cl.
*E02D 13/04* (2006.01)
*E02D 7/02* (2006.01)
*E02D 27/52* (2006.01)

(52) U.S. Cl.
CPC ..... *E02D 13/04* (2013.01); *E02D 7/02* (2013.01); *E02D 27/525* (2013.01); *E02D 2200/1685* (2013.01); *E02D 2250/0061* (2013.01)

(58) Field of Classification Search
CPC .... E02D 13/04; E02D 7/02; E02B 2017/0043
(Continued)

(56) References Cited

U.S. PATENT DOCUMENTS 6,994,493 B2 2/2006 Jones
8,926,226 B2 1/2015 Vandenbulcke et al.
(Continued)

FOREIGN PATENT DOCUMENTS

EP 2492402 A1 8/2012
EP 2546418 A1 1/2013
WO 03074795 A1 9/2003

OTHER PUBLICATIONS

International Search Report dated Sep. 20, 2018, for corresponding International Patent Application No. PCT/NL2018/050371, filed Jun. 7, 2018.

(Continued)

*Primary Examiner* — Sean D Andrish
(74) *Attorney, Agent, or Firm* — Steven M. Koehler; Westman, Champlin & Koehler, P.A.

(57) ABSTRACT

A template for installing piles underwater includes a template frame and pile guides having parallel pile guide centerlines and being fixed to the template frame. Each pile guide has a pile guide frame that surrounds a passageway configured for passing a pile therethrough. Each pile guide frame includes upper and lower ends. Each pile guide includes a spacer fixed to the pile guide frame and protruding into the passageway. The spacer has a pile contact surface for guiding a pile. The pile contact surface encloses an imaginary cylinder including a centerline which coincides with the pile guide centerline. In a circumferential direction about the pile guide centerline, the location of the pile contact surface shifts with respect to the corresponding pile guide frame in a direction from the lower end to the (Continued)

upper end thereof as seen in a direction from the template center to the pile guide centerline.

14 Claims, 3 Drawing Sheets

(58) Field of Classification Search
USPC ..... 405/227
See application file for complete search history.

(56) References Cited

U.S. PATENT DOCUMENTS

| | | | | |
|---|---|---|---|---|
| 2005/0117976 | A1 | 6/2005 | Jones | |
| 2011/0170956 | A1* | 7/2011 | Vandenbulcke | E02D 27/50 405/227 |
| 2012/0213594 | A1 | 8/2012 | Vandenbulcke et al. | |
| 2013/0183101 | A1 | 7/2013 | Vandenbulcke et al. | |

OTHER PUBLICATIONS

Written Opinion of the International Searching Authority dated Sep. 20, 2018, for corresponding International Patent Application No. PCT/NL2018/050371, filed Jun. 7, 2018.

* cited by examiner

TEMPLATE AND A METHOD OF USING THE TEMPLATE

CROSS-REFERENCE TO RELATED APPLICATION

The present application is a national stage of and claims priority of International patent application Serial No. PCT/NL2018/050371, filed Jun. 7, 2018, and published in English as WO 2018/231049.

BACKGROUND

The present invention relates to a template for use in installing a plurality of piles relative to one another in an underwater ground formation, comprising a template frame and a plurality of pile guides having parallel pile guide centerlines and being fixed to the template frame, wherein each pile guide is provided with a pile guide frame that surrounds a passageway configured for passing a pile therethrough, wherein each pile guide frame includes an upper end and a lower end and the template has a template center located in the middle of the pile guide centerlines, wherein each pile guide is provided with a spacer being fixed to the pile guide frame and protruding into the passageway, wherein the spacer has a pile contact surface for guiding a pile during driving it into the ground, which pile contact surface encloses an imaginary cylinder including a centerline which coincides with the pile guide centerline.

SUMMARY

A template is disclosed where in a circumferential direction about the pile guide centerline, the location of the pile contact surface shifts with respect to the corresponding pile guide frame in a direction from the lower end to the upper end thereof as seen in a direction from the template center to the pile guide centerline.

This means that under operating conditions of the template, as seen in a direction from the template center to one of the pile guide centerlines, the height level of the pile contact surface increases. The lowest level of the pile contact surface lies at the side of the pile guide where the template center is located and the highest level of the pile contact surface lies at the side of the pile guide which is directed away from the template center. This provides the opportunity to easily remove the template from piles after these have been driven into the ground whereas upper sections of the piles are still contacting the pile contact surfaces of the respective spacers; an automatic releasing mechanism appears to occur during lifting the template.

More specifically, in practice when lifting the template it will automatically tilt about a location where one of the pile guides clamps to the corresponding pile the most severely; at locations where the pile guides do not clamp or exert a smaller clamping force to the corresponding pile, the pile guide will shift along the pile in upward direction. Consequently, at the strongest clamping location the pile guide rotates with respect to the corresponding pile such that at least a part of the pile contact surface of its spacer will lose contact with the pile due to the shifted profile of the pile contact surface. In fact, as seen along the pile the opening defined by the contact surface changes from a circular to a substantially oval or elliptical shape upon tilting the pile guide. After a certain degree of tilting the template the pile guide that initially clamped most severely on the corresponding pile will be released and shift upwardly along the pile. After this, if the template can still not be lifted entirely from the piles, the same process may repeat when the template tilts about a location where another pile guide clamps the most severely to a corresponding pile. Due to the automatic releasing process no movable spacer elements are required by the template according to the invention.

It is noted that the width of the pile contact surface may be much smaller than the distance between the upper end and lower end of the pile guide frame.

In a practical embodiment the pile contact surface extends parallel to a plane which is angled with respect to a base plane that extends perpendicular to the pile guide centerlines.

In a particular embodiment the spacer comprises a plurality of spacer elements located at angular distance from each other about the pile guide centerline, hence forming a discontinuous pile contact surface comprising discrete contact surface portions at the respective spacer elements.

The contact surface portions of a pile guide may be oblong and have longitudinal directions which extend parallel to the pile guide centerline. In this case the pile contact surface forms a discontinuous belt about the pile guide centerline, wherein the belt has a certain width. When the pile contact surfaces have equal lengths, such a belt has a constant width.

The contact surface portions of neighboring spacer elements may overlap each other in a direction along the pile guide centerline. It is conceivable that they do not overlap, for example in case of a small number of spacer elements.

In a practical embodiment each of the pile guide frames comprises a cylindrical tube. The spacer can be easily fixed to the inner side of the tube.

In a particular embodiment the spacer of the pile guide forms a lower spacer and the pile guide comprises an upper spacer which is located between the lower spacer and the upper end of the pile guide frame. In this case the pile guide can guide a pile over a large distance by both the lower and upper spacers, whereas only the upper section of a pile is guided by only the lower spacer when the pile has left the upper spacer during its displacement in downward direction.

More specifically, the upper spacer may have an upper pile contact surface for guiding a pile during driving it into the ground, which encloses the imaginary cylinder. The upper pile contact surface does not require an inclined orientation with respect to a base plane that extends perpendicular to the pile guide centerlines if the piles in practice are driven until their tops reach a position beyond the upper spacer as seen from above.

The spacer elements of the lower spacer may form lower spacer elements, wherein the upper spacer comprises a plurality of upper spacer elements located at angular distance from each other about the pile guide centerline, hence forming a discontinuous upper pile contact surface comprising discrete contact surface portions at the upper spacer elements.

The upper spacer elements may be displaceable in radial direction with respect to the pile guide frame, which provides space for a hammer to drive a pile beyond the upper spacer elements.

An aspect of the invention is also related to a method of using the template as described hereinbefore, wherein the template is placed on the ground, piles are inserted into the respective pile guides and driven into the ground until upper ends of the respective piles have arrived at the pile contact surface of the spacer or, if applicable, at a position beyond the upper pile contact surface of the upper spacer, after which the template is lifted from the piles that are driven into the ground.

BRIEF DESCRIPTION OF THE DRAWING

Aspects of the invention will hereafter be elucidated with reference to very schematic drawings showing an embodiment of the invention by way of example.

DETAILED DESCRIPTION OF THE ILLUSTRATIVE EMBODIEMNTS

FIGS. 1-5 show different views of an embodiment of a template 1 for use in installing a plurality of piles relative to one another in an underwater ground formation. Such a subsea pile installation template is typically used for installing pre-piling jacket piles onto which a jacket will be placed, for example as a foundation for offshore wind turbines. The template 1 is positioned on the sea bottom to make sure the piles are being installed at the correct location and driven in the correct direction.

Figure 1:
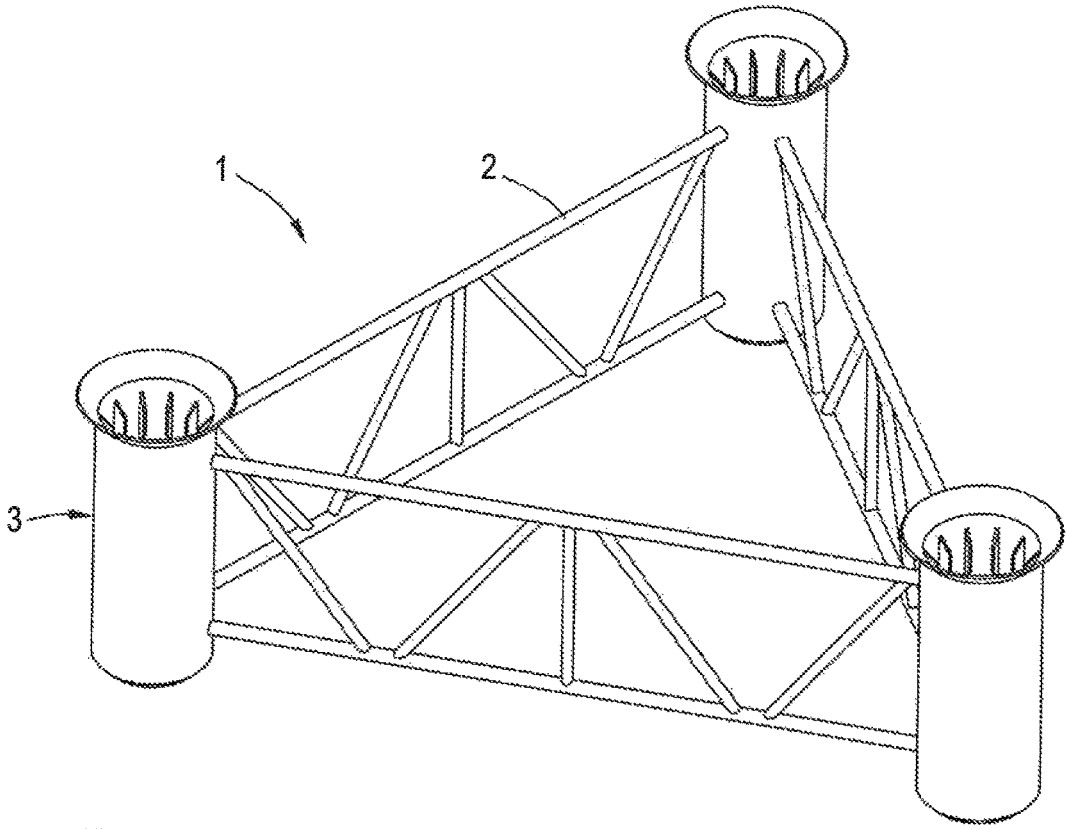
FIG. 1 is a perspective view of an embodiment of a template.
Figure 2:
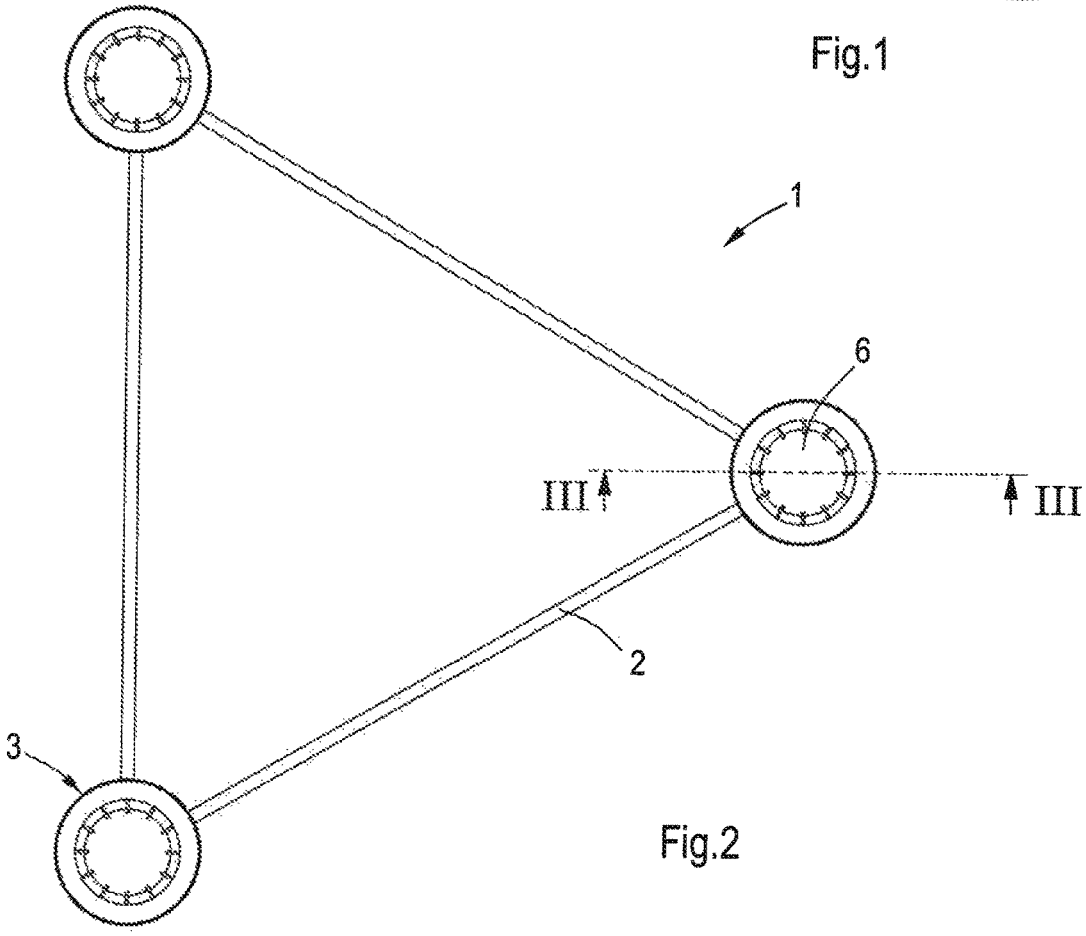
FIG. 2 is a top view of the embodiment as shown in FIG. 1.
Figure 3:
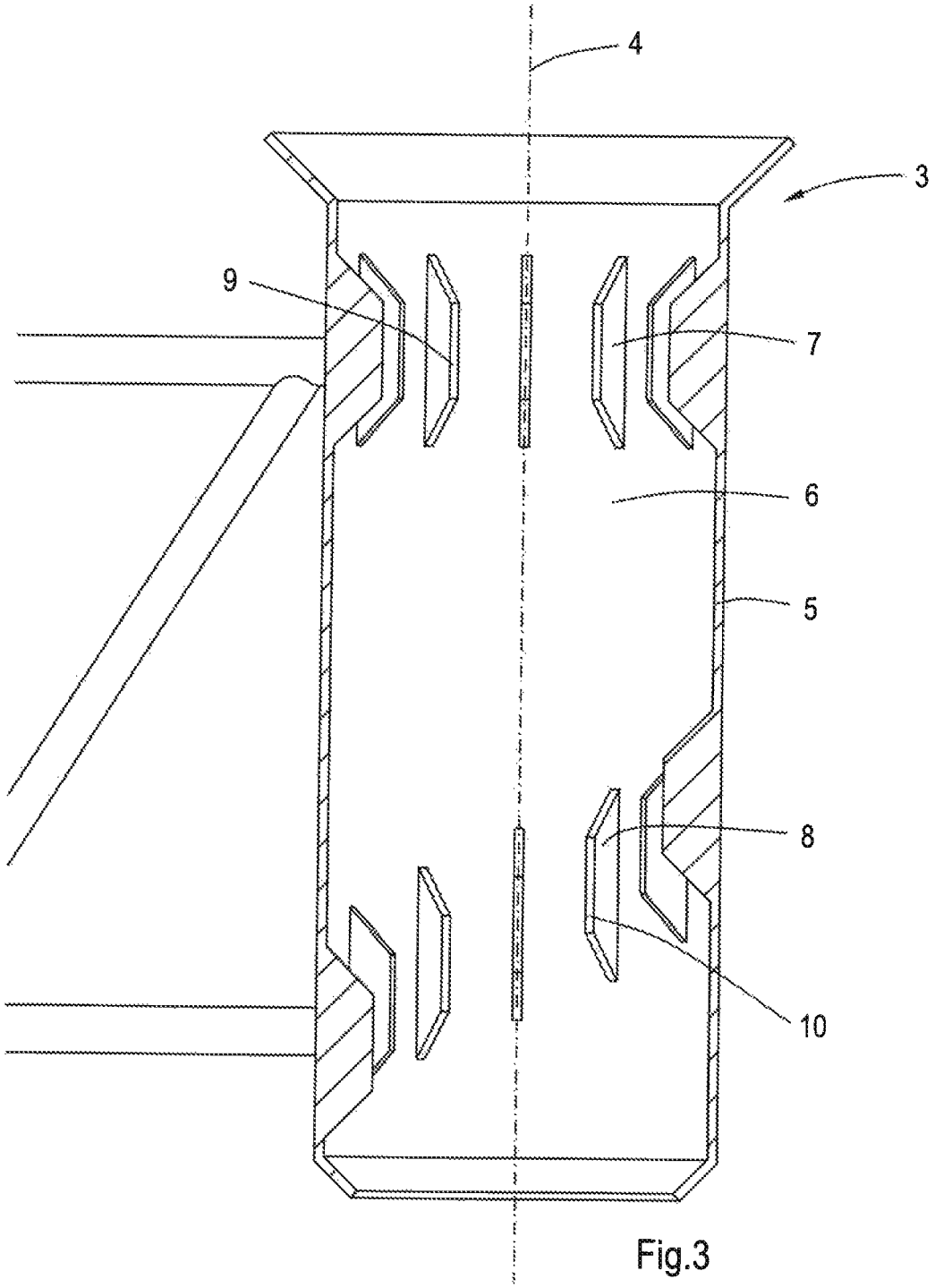
FIG. 3 is an enlarged cross-sectional view of a part of the embodiment according to FIG. 1 as indicated by III-III in FIG. 2.
Figure 4:
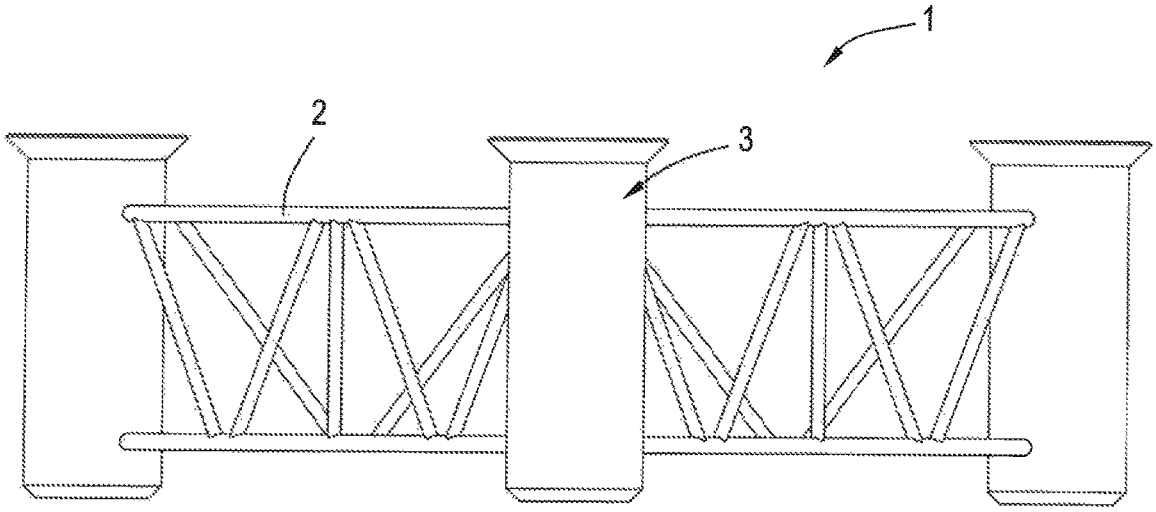
FIG. 4 is a side view of the embodiment of FIG. 1.
Figure 5:
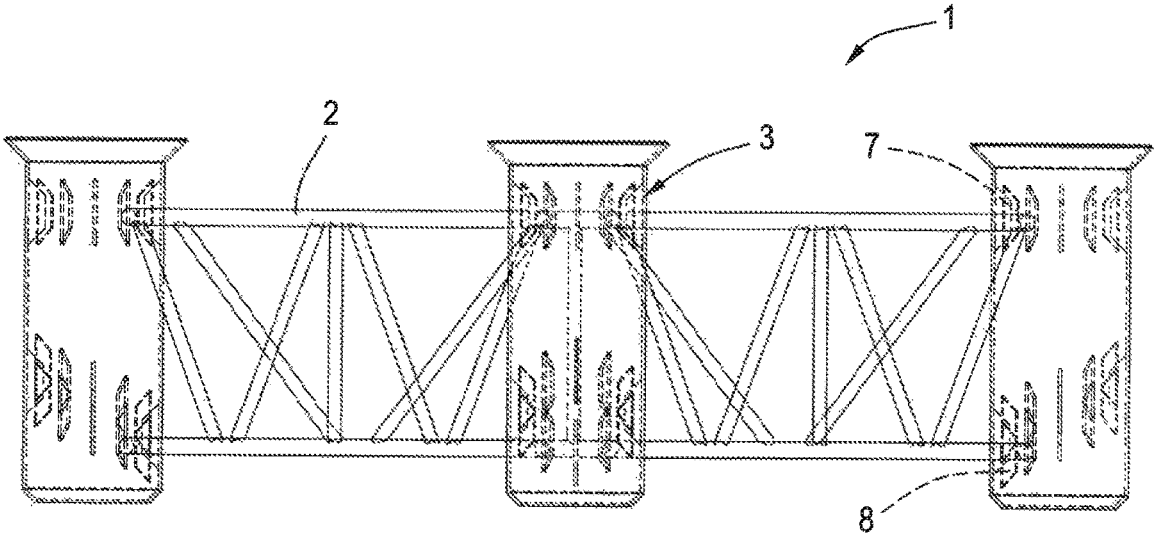
FIG. 5 is a similar view as FIG. 4, but showing details of the inner sides of pile guides of the template.

The embodiment of the template 1 comprises a template frame 2, for example a welded framework, and three pile guides 3, but a different number of pile guides 3 is conceivable. As shown in FIG. 3 each pile guide 3 has a pile guide centerline 4. The centerlines 4 are parallel to each other. The pile guides 3 are each provided with a pile guide frame 5 which is fixed to the template frame 2. In the embodiment as shown in FIG. 1 the pile guide frame 5 comprises a cylindrical tube that surrounds a passageway 6 through which a pile can be passed during driving it into the ground. An upper end portion of the pile guide frame 5 has a conical portion for easily guiding a pile into the passageway 6. Lower ends of the pile guide frames 5 may rest on the sea bottom under operating conditions. The template 1 has a template center which is defined in the middle of the pile guide centerlines 4, in this case in the middle of the triangular shape of the template 1.

FIG. 3 shows that each of the pile guides 3 is provided with upper spacer elements 7 and lower spacer elements 8. In this case there are 12 upper spacer elements 7 and 12 lower spacer elements 8, but different numbers are conceivable. The distance between the lower spacer elements 8 and the upper spacer elements 7 is larger than the height of any one of the spacer elements 7, 8 in this case. The spacer elements 7, 8 are fixed to the pile guide frame 5 at angular distance from each other about the pile guide centerline 4 and protrude into the passageway 6. The spacer elements 7, 8 have respective discrete contact surface portions 9, 10 for guiding a pile during driving it into the ground. In this case the contact surface portions 9, 10 are oblong and have equal lengths in a direction parallel to the pile guide centerline 4. The contact surface portions 9, 10 are directed to the pile guide centerline 4 and may comprise rectangular flat or curved surfaces.

The contact surface portions 9, 10 of both the upper spacer elements 7 and the lower spacer elements 8 form a discontinuous upper pile contact surface and a discontinuous lower pile contact surface, respectively, which enclose an imaginary cylinder including a centerline which coincides with the pile guide centerline 4. This means that the upper pile contact surface and the lower pile contact surface may contact and guide a pile during driving it into the ground.

In the embodiment as shown the upper and lower contact surface portions form respective virtual discontinuous belts about the respective pile guide centerlines 4. FIG. 3 shows that the upper pile contact surface runs parallel to a virtual base plane which extends perpendicular to the pile guide centerlines 4, whereas the lower pile contact surface extends parallel to a plane which is angled with respect to the base plane. As seen in a direction from the template center to each of the pile guide centerlines 4 the location of the lower pile contact surface shifts in a direction from the lower end to the upper end of the pile guide frame 5 along the circumference of the tubular pile guide frame 5. In other words, the lower spacer elements 8 of each of the pile guides 3 are placed in a staggered manner in upward direction as seen in a direction from the template center to the corresponding pile guide centerline 4. In the embodiment as shown the lower spacer elements 8 are positioned such that the contact surface portions 10 of neighbouring spacer elements 8 overlap each other in a direction along the pile guide centerline 4.

Prior to driving piles into the ground the template 1 is placed onto the seabed. Subsequently, piles are successively inserted into the passageways 6 and driven into the ground. The piles are driven until their upper ends arrive at a position beyond the contact surface portions 9 of the upper spacer elements 9 as seen from above. After the last pile has been driven into the ground the template 1 is removed from the piles by lifting it. In practice, one of the pile guides 3 may clamp to the corresponding pile the most severely. The template 1 will automatically tilt about that clamping location during lifting the template 1. Consequently, the corresponding pile guide 3 rotates with respect to the clamping pile such that at least a part of the contact surface portions 10 of the lower spacer elements 8 lose contact with the pile due to their staggered positions with respect to the pile. As seen from the pile the opening defined by the contact surface portions 10 of the lower spacer elements 8 changes from a circular to an elliptical shape, hence providing the pile guide 3 more room to shift upwardly along the pile. After a certain degree of tilting of the template 1 the pile guide 3 that initially clamped most severely on the corresponding pile will be released and shift upwardly along the pile. In the meantime, another pile guide 3, which initially clamped less severely to a corresponding pile, may increasingly clamp during the lifting operation. The same process may repeat when the template 1 subsequently tilts about a location where the other pile guide 3 now clamps the most severely to the corresponding pile.

The invention is not limited to the embodiment shown in the drawings and described hereinbefore, which may be varied in different manners within the scope of the claims and their technical equivalents. For example, the upper spacer elements may be displaceable in radial direction with respect to the pile guide frame in order to allow a hammer to pass the upper spacer elements. Furthermore, the upper spacer elements may be integrated into a single upper spacer including a continuous upper pile contact surface instead of discrete upper contact surface portions. Similarly, the lower spacer elements may be integrated into a single lower spacer including a continuous lower pile contact surface instead of discrete contact surface portions of the lower spacer elements.

The invention claimed is:

1. A template for use in installing a plurality of piles relative to one another in an underwater ground formation, comprising a template frame and a plurality of pile guides being fixed to the template frame, wherein each pile guide includes a pile guide centerline and is provided with a pile guide frame that surrounds a passageway configured for passing a pile of the plurality of piles therethrough, wherein the pile guide centerlines are parallel to each other, wherein each pile guide frame includes an upper end and a lower end and the template has a template center located in a middle of the pile guide centerlines, wherein each pile guide is provided with a spacer being fixed to the pile guide frame and protruding into the passageway, wherein each spacer has a pile contact surface about the associated passageway and configured to guide the pile during driving the pile into the ground formation, wherein each pile contact surface is disposed on an inner surface of the associated pile guide frame about the associated passageway and associated pile guide centerline, and wherein in a circumferential direction about each pile guide centerline for each pile guide a location of the associated pile contact surface shifts with respect to the corresponding pile guide frame in a direction from the lower end to the upper end thereof as seen in a direction from the template center to each associated pile guide centerline.

2. The template according to claim 1, wherein each pile contact surface extends parallel to a plane which is angled with respect to a base plane that extends perpendicular to the pile guide centerlines.

3. The template according to claim 1, wherein each spacer comprises a plurality of spacer elements located at angular distance from each other about the associated pile guide centerline, hence forming a discontinuous pile contact surface comprising discrete contact surface portions at respective spacer elements.

4. The template according to claim 3, wherein the contact surface portions of each pile guide are oblong having longitudinal directions which extend parallel to the associated pile guide centerline.

5. The template according to claim 3, wherein the contact surface portions have equal lengths.

6. The template according to claim 3, wherein the contact surface portions of neighboring spacer elements overlap each other in a direction along each pile guide centerline.

7. The template according to claim 3, wherein each spacer of each pile guide forms a lower spacer and each pile guide comprises an upper spacer which is located between the associated lower spacer and the associated upper end of the pile guide frame.

8. The template according to claim 7, wherein each upper spacer has an upper pile contact surface configured to guide the pile during driving the pile into the ground formation, which encloses said associated passageway.

9. The template according to claim 7, wherein the spacer elements of each lower spacer form lower spacer elements and wherein each upper spacer comprises a plurality of upper spacer elements located at an angular distance from each other about the associated pile guide centerline, hence forming a discontinuous upper pile contact surface comprising discrete contact surface portions at the upper spacer elements.

10. The template according to claim 9, wherein the upper spacer elements of each pile guide are displaceable in a radial direction with respect to the pile guide frame.

11. The template according to claim 1, wherein each of the pile guide frames comprises a cylindrical tube.

12. A method of using a template for installing a plurality of piles relative to one another, the template comprising a plurality of pile guides being fixed to a template frame, wherein each pile guide includes a pile guide centerline and is provided with a pile guide frame that surrounds a passageway configured for passing a pile of the plurality of piles therethrough, wherein the pile guide centerlines are parallel to each other, wherein each pile guide frame includes an upper end and a lower end and the template has a template center located in a middle of the pile guide centerlines, wherein each pile guide is provided with a spacer being fixed to the pile guide frame and protruding into the passageway, wherein each spacer has a pile contact surface on the pile guide frame and about the associated passageway having a centerline which coincides with the associated pile guide centerline, and wherein in a circumferential direction about each pile guide centerline a location of the associated pile contact surface shifts with respect to the corresponding pile guide frame in a direction from the lower end to the upper end thereof as seen in a direction from the template center to each associated pile guide centerline, the method comprising placing the template on a ground formation, inserting a pile of the plurality of piles into each respective pile guide, driving each pile into the ground formation until upper ends of the respective piles have arrived at desired positions with respect to each respective pile guide, after which the template is lifted from the piles that are driven into the ground formation.

13. A method of using a template for installing a plurality of piles relative to one another, the template having a plurality of pile guides, each guide having a spacer with a pile contact surface, the method comprising placing the template on a ground formation, inserting a pile of the plurality of piles into each respective pile guide, driving each pile into the ground formation until upper ends of the respective piles have arrived at desired positions with respect to each respective pile guide, lifting the template upward on the plurality of piles until contact of one of the spacers with the associated pile inhibits upward movement of the template after which the template is tilted to cause at least a part of the pile contact surface of the one of the spacers to lose contact with the associated pile, the associated pile being one of the plurality of piles.

14. The method according to claim 13, wherein lifting and tilting the template includes, after the tilting the template causes the at least a part of the pile contact surface of the one of the spacers to lose contact with the associated pile and the one of the spacers moves along the associated pile, further lifting the template upward on the plurality of piles until contact of another one of the spacers with the associated pile inhibits upward movement of the template after which the template is tilted to cause at least a part of the pile contact surface of the another one of the spacers to lose contact with an associated second pile, the second associated pile being one of the plurality of piles and different than the associated pile.

* * * * *